US009331383B2

(12) United States Patent
Du et al.

(10) Patent No.: US 9,331,383 B2
(45) Date of Patent: May 3, 2016

(54) ANTENNA STRUCTURE AND THE MANUFACTURING METHOD THEREFOR

(71) Applicant: ARCADYAN TECHNOLOGY CORPORATION, Hsinchu (TW)

(72) Inventors: Jian-Jhih Du, Hsinchu (TW); Chih-Yung Huang, Hsinchu (TW); Kuo-Chang Lo, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 328 days.

(21) Appl. No.: 13/950,727

(22) Filed: Jul. 25, 2013

(65) Prior Publication Data

US 2014/0285380 A1 Sep. 25, 2014

(30) Foreign Application Priority Data

Mar. 21, 2013 (TW) ..... 102110130 A

(51) Int. Cl.

| | |
|---|---|
| ***H01Q 1/38*** | (2006.01) |
| ***H01P 11/00*** | (2006.01) |
| ***H01Q 1/24*** | (2006.01) |
| ***H01Q 9/40*** | (2006.01) |
| ***H01Q 9/42*** | (2006.01) |

(52) U.S. Cl.

CPC ..... *H01Q 1/38* (2013.01); *H01P 11/001* (2013.01); *H01Q 1/243* (2013.01); *H01Q 9/40* (2013.01); *H01Q 9/42* (2013.01); *Y10T 29/49016* (2015.01)

(58) Field of Classification Search

CPC ..... H01Q 1/38; H01Q 1/243; H01Q 1/40; H01Q 1/42; H01P 11/001

See application file for complete search history.

(56) References Cited

U.S. PATENT DOCUMENTS

| | | | | |
|---|---|---|---|---|
| 6,700,543 | B2 * | 3/2004 | Konishi | H01Q 1/38 343/700 MS |
| 6,788,257 | B2 * | 9/2004 | Fang | H01Q 9/0421 343/700 MS |
| 8,063,827 | B2 * | 11/2011 | Hotta | H01Q 1/243 343/700 MS |
| 8,223,076 | B2 * | 7/2012 | Huang | H01Q 1/38 343/700 MS |
| 2001/0050651 | A1 * | 12/2001 | Grangeat | H01Q 13/106 343/767 |
| 2010/0220030 | A1 * | 9/2010 | Shimoda | H01Q 1/243 343/860 |
| 2010/0245198 | A1 * | 9/2010 | Wilson | H01Q 1/243 343/767 |
| 2014/0002309 | A1 * | 1/2014 | Huang | H01Q 1/38 343/700 MS |
| 2014/0009359 | A1 * | 1/2014 | Huang | H01Q 1/38 343/846 |
| 2014/0145909 | A1 * | 5/2014 | Chen | H01Q 9/0407 343/893 |
| 2014/0168028 | A1 * | 6/2014 | Yanagi | H01Q 1/38 343/848 |

FOREIGN PATENT DOCUMENTS

| | | |
|---|---|---|
| CN | 1886883 | 12/2006 |
| CN | 101719598 | 6/2010 |
| TW | I368355 | 7/2012 |

* cited by examiner

*Primary Examiner* — Trinh Dinh

(74) *Attorney, Agent, or Firm* — Allen, Dyer, Doppelt, Milbrath & Gilchrist, P.A.

(57) ABSTRACT

An antenna structure is provided. The antenna structure includes a radiating portion having an approximately quadrangular body, wherein the quadrangular body has a first side, a second side opposite to the first side, a third side, and a fourth side opposite to the third side; and a ground portion surrounding an entire length of the first side, an entire length of the fourth side, and at most a half of a length of the second side.

8 Claims, 5 Drawing Sheets

ANTENNA STRUCTURE AND THE MANUFACTURING METHOD THEREFOR

CROSS-REFERENCE TO RELATED APPLICATION AND CLAIM OF PRIORITY

The application claims the benefit of Taiwan Patent Application No. 102110130, filed on Mar. 21, 2013, in the Taiwan Intellectual Property Office, the disclosures of which are incorporated herein in their entirety by reference.

FIELD OF THE INVENTION

The present invention relates to an antenna device, and more particularly to a monopole antenna structure with a single central operating frequency.

BACKGROUND OF THE INVENTION

Nowadays, various compact antennas have been developed and applied to various compact hand-held electronic devices (e.g. cellphones or notebook computers) or the wireless transmission device (e.g. the AP). For example, the planar inverse-F antenna (PIFA) or the monopole antenna that is compact, has a good transmitting efficiency, and can be easily disposed on the inner wall of the hand-held electronic device already exists, and is widely applied to various hand-held electronic devices for wireless transmission, the notebook computer or the wireless communicating device. Traditionally, the inner conductor layer and the outer conductor layer of the coaxial cable are respectively welded to the signal feeding point and the signal ground point of the PIFA so that the signal to be transmitted is output via the PIFA. The monopole antenna is one of the most traditional and classical antennas, which has a simple structure, a small size, a light weight, a low cost as well as a small standing wave coefficient, and is omnidirectional. However, in order for the monopole antenna to be applied to different bandwidths, it is necessary to increase the bandwidth of the monopole antenna. Commonly, there are two ways to increase the bandwidth of the monopole antenna. One is to load the monopole antenna, and the other is to use the planar monopole antenna. Loading the monopole antenna will cause the size thereof to be larger and reduce the radiating efficiency thereof. The planar monopole antenna has a larger impedance bandwidth, but its radiating direction has a larger change in the bandwidth and is more inconsistent. Besides, the size of the planar monopole antenna is larger.

In order to overcome the drawbacks in the prior art, an antenna structure and the manufacturing method therefor are provided. The particular design in the present invention not only solves the problems described above, but also is easy to be implemented. Thus, the present invention has the utility for the industry.

SUMMARY OF THE INVENTION

In accordance with an aspect of the present invention, an antenna structure is provided. The antenna structure includes a radiating portion having a quadrangular body, wherein the quadrangular body has a first side, a second side opposite to the first side, a third side, and a fourth side opposite to the third side; a feeding terminal adjacent to the first side and connected to a microstrip; a first extending portion determining a central operating frequency of the antenna structure, wherein the first extending portion extends toward a first direction from the second side, forms a bend, and then extends toward a second direction so that a first space is formed between the first extending portion and the second side, wherein a width of the first space along the first direction is a first distance; a second extending portion determining an operating bandwidth of the antenna structure, wherein the second extending portion extends toward the second direction from the third side, wherein a distance between the first extending portion and the second extending portion along the first direction is a second distance; and a ground portion surrounding an entire length of the first side, an entire length of the fourth side, and at most a half of a length of the second side, wherein the ground portion is not electrically connected to the radiating portion, the first extending portion has a length larger than that of the second extending portion, the second distance is larger than the first distance, and the microstrip extends toward the ground portion to be connected to a feeding signal.

In accordance with another aspect of the present invention, an antenna structure is provided. The antenna structure includes a radiating portion having a quadrangular body, wherein the quadrangular body has a first side, a second side opposite to the first side, a third side, and a fourth side opposite to the third side; a feeding terminal adjacent to the first side; a first extending portion determining a central operating frequency of the antenna structure, and extending from the second side to form a first space between the first extending portion and the second side, wherein the first extending portion includes a connecting end and an open end, wherein the connecting end is connected to the second side, extends toward a first direction from the second side, forms a first bend, and then extends toward a second direction; and a second extending portion determining an operating bandwidth of the antenna structure, wherein the second extending portion extends from the third side, wherein a length of the first extending portion along the second direction is larger than a length of the second extending portion, the first extending portion has a width smaller than that of the second extending portion, the width of the first extending portion is smaller than a length of the second side, and the width of the second extending portion is smaller than a length of the third side.

In accordance with a further aspect of the present invention, a method for manufacturing an antenna structure is provided. The method includes steps of providing a radiating portion having a quadrangular body, wherein the quadrangular body has a first side, a second side opposite to the first side, a third side, and a fourth side opposite to the third side; providing a first extending portion for determining a central operating frequency of the antenna structure, wherein the first extending portion extends toward a first direction from the second side, forms a bend, and then extends toward a second direction so that a first space is formed between the first extending portion and the second side; and providing a second extending portion for determining an operating bandwidth of the antenna structure, wherein the second extending portion extends toward the second direction from the third side, wherein the third side, the first extending portion, and the second extending portion have a second space therebetween, and the second space is larger than the first space.

In accordance with further another aspect of the present invention, an antenna structure is provided. The antenna structure includes a radiating portion having an approximately quadrangular body, wherein the quadrangular body has a first side, a second side opposite to the first side, a third side, and a fourth side opposite to the third side; and a ground portion surrounding an entire length of the first side, an entire length of the fourth side, and at most a half of a length of the second side.

The above objects and advantages of the present invention will become more readily apparent to those ordinarily skilled in the art after reviewing the following detailed descriptions and accompanying drawings, in which:

BRIEF DESCRIPTION OF THE DRAWINGS

FIG. 1(*b*) is a lateral view of the antenna structure of FIG. 1(*a*);

FIG. 2(*b*) is a front view of a radiating portion in the antenna structure of FIG. 1(*a*);

FIG. 3(*b*) shows the relationship between the parameter D2 and the return loss;

FIG. 3(*c*) shows the relationship between the parameter D3 and the return loss;

FIG. 3(*d*) shows the relationship between the parameter D4 and the return loss.

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

The object of the present invention is to provide an antenna structure and the manufacturing method therefor, wherein the built-in monopole antenna is suitable for the hand-held electronic device, and can be easily adjusted and modified according to the product demand to achieve the appropriate application. For example, the hand-held electronic device can be a notebook computer, a personal digital assistant, a cellphone, etc. The present invention can be applied to the operating band of WiFi 802.11b/g/n (2.40~2.50 GHz), to the operating band of the long term evolution (LTE), to the wireless communicating device, or to the system with an LTE band of 2300 MHz~2700 MHz. For example, the operating band of the LTE can be the LTE-Band 7 (2500~2690 MHz), the LTE-Band 40 (2300~2400 MHz) or the LTE-Band 38 (2570~2620 MHz). For example, the wireless communicating device can be a notebook computer, a cellphone, an AP, a TV including the WiFi, etc. Besides, the band of the present invention can be slightly adjusted to be applied to the wireless communicating systems with other operating bands.

Figure 1A:
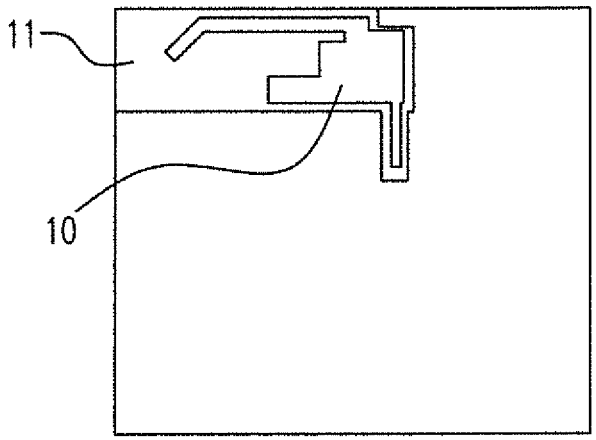
FIG. 1(*a*) is a front view of an antenna structure according to an embodiment of the present invention.
Figure 1B:
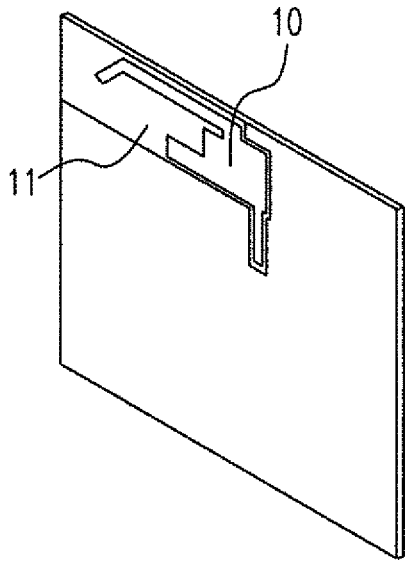
Figure 2A:
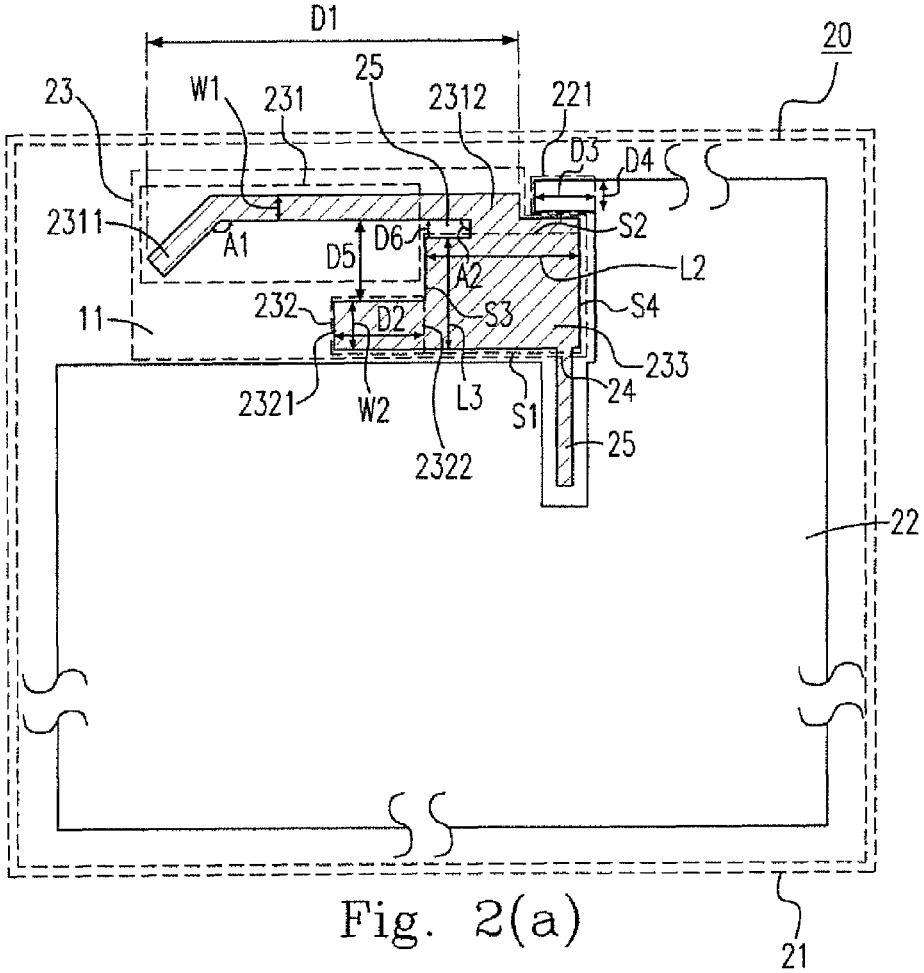
FIG. 2(*a*) is a detailed front view of the antenna structure of FIG. 1(*a*)
Figure 2B:
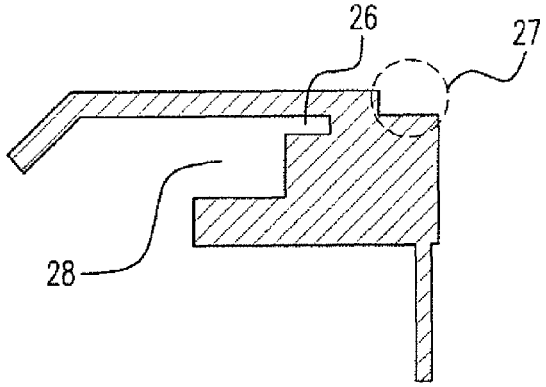
Figure 3A:
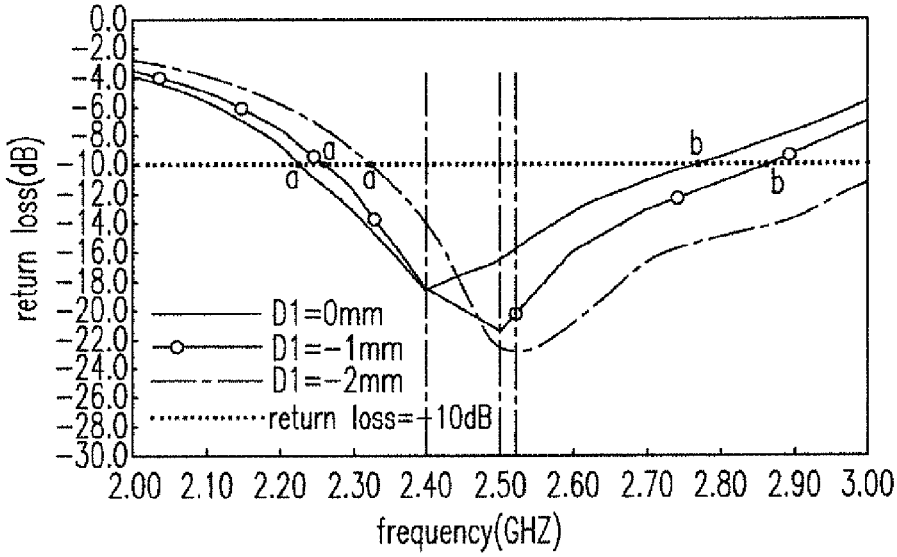
FIG. 3(*a*) shows the relationship between the parameter D1 and the return loss.
Figure 3B:
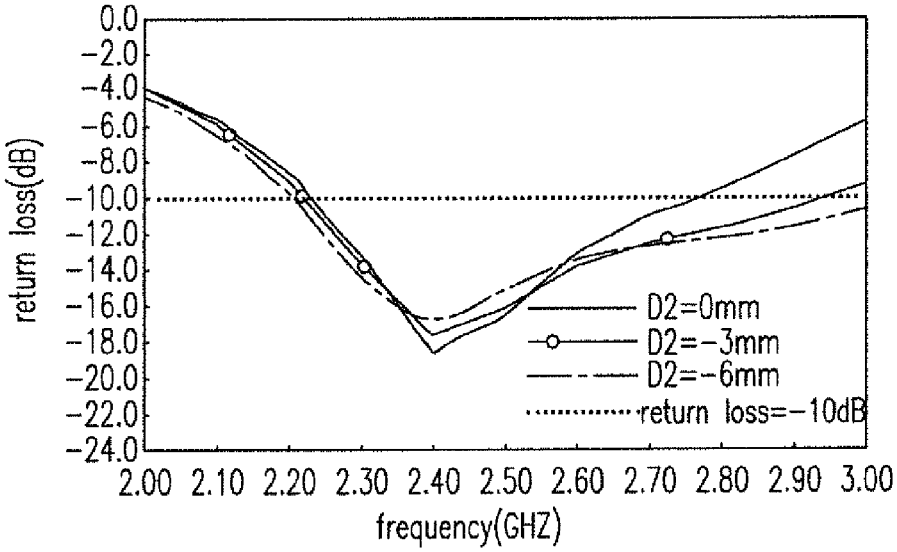
Figure 3C:
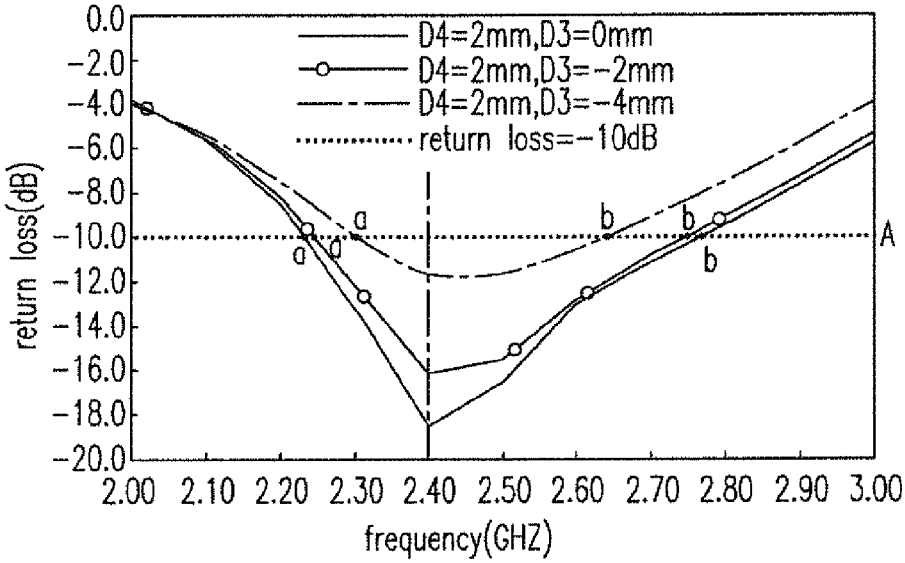
Figure 3D:
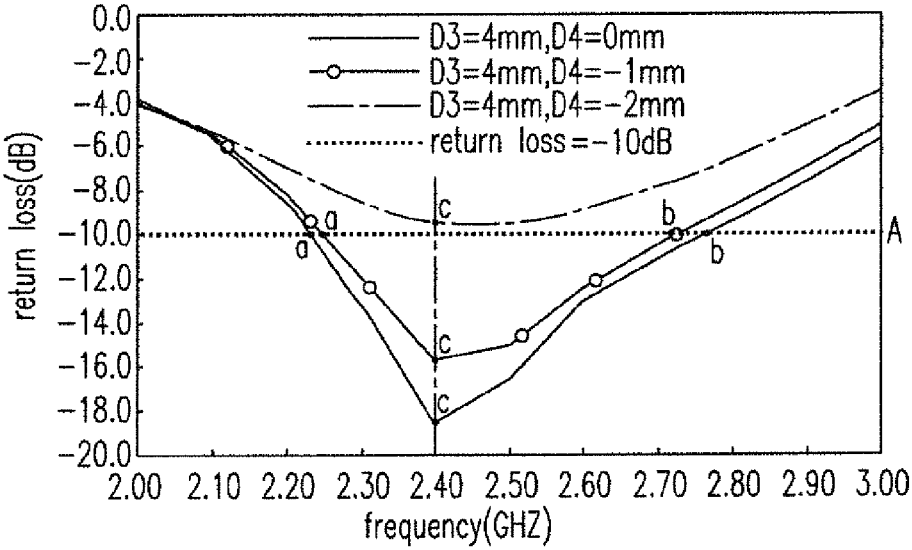

Please refer to FIGS. 1(*a*), 1(*b*), 2(*a*) and 2(*b*). FIG. 1(*a*) is a front view of an antenna structure according to an embodiment of the present invention, FIG. 1(*b*) is a lateral view of the antenna structure of FIG. 1(*a*), FIG. 2(*a*) is a detailed front view of the antenna structure of FIG. 1(*a*), and FIG. 2(*b*) is a front view of a radiating portion in the antenna structure of FIG. 1(*a*). As shown in FIGS. 1(*a*) and 1(*b*), in the present invention, a printed monopole antenna 10 formed as a unit is disposed on a dielectric layer 11 of a substrate 21. As shown in FIG. 2(*a*), the antenna structure 20 has a single central operating frequency under a single bandwidth, and includes a substrate 21, a radiating portion 23, a feeding terminal 24, a microstrip 25 and a ground portion 22 having a ground extending region 221. The radiating portion 23 includes a first extending portion 231, a second extending portion 232 and a body 233. As shown in FIG. 2(*b*), the radiating portion 23 further includes a first space 26 and a first indent 27.

The first extending portion 231 has a connecting end 2312 and an open end 2311. The second extending portion 232 has a connecting end 2322 and an open end 2321. The body 233 is approximately quadrangular, and has a first side S1, a second side S2 opposite to the first side S1, a third side S3 and a fourth side S4 opposite to the third side S3.

The first extending portion 231 is connected to the second side S2 of the body 233 via the connecting end 2312. The open end 2311 extends toward a first direction from the second side S2, forms a bend, and then extends toward a second direction so that the first space 26 is formed between the first extending portion 231 and the body 233. The second extending portion 232 is connected to the third side S3 of the body 233, and extends toward a second direction from the third side S3. The second extending portion 232 is approximately parallel with the first extending portion 231. The first extending portion 231 determines a central operating frequency of the antenna structure 20, and the second extending portion 232 determines an operating bandwidth thereof.

There is a first distance D5 between the first extending portion 231 and the second extending portion 232. There is a second distance D6 between the first extending portion 231 and the body 233. D6 is smaller than D5.

The first extending portion 231 has at least two bends. The bend between the body 233 and the connecting end 2312 has an interior angle A2 of 90 degrees. The first extending portion 231 near the open end 2311 has another bend having an interior angle A1 larger than 90 degrees.

The width W1 of the first extending portion 231 is smaller than the width W2 of the second extending portion 232. The width W1 of the first extending portion 231 and the width W2 of the second extending portion 232 are both smaller than that of the body 233. The width W2 of the second extending portion 232 is smaller than the length L3 of the third side S3.

The length D1 of the first extending portion 231 is larger than the length D2 of the second extending portion 232. According to an embodiment of the present invention, the length D1 of the first extending portion 231 is at least three times the length D2 of the second extending portion 232.

The feeding terminal 24 is connected to the first side S1 for feeding a signal, and is connected to the microstrip 25. The microstrip 25 extends toward the ground portion 22 along a third direction to be connected to the feeded signal, wherein an end of the microtrip 25 can be arbitrarily extended.

The ground portion 22 has a ground extending region 221, and surrounds the first side S1, the fourth side S4 and a part of the second side S2.

The ground extending region 221 has a length D3 and a width D4. The size of the ground extending region 221 is corresponding to that of the indent 27. The size of the ground extending region 221, i.e. the ratio of the length D3 to the width D4, adjusts the impedance matching of the antenna structure 20, thereby enabling the voltage standing wave ratio (VAWR) of the antenna structure 20 to reach the standard and requirement of the industry.

The first space 26 is to increase the length of the first extending portion 231 to obtain the central frequency to be used, without increasing the overall size of the antenna structure 20.

According to an embodiment of the present invention, the length D3 of the ground extending region is 4 mm, and the width D4 thereof is 2 mm.

Please refer to FIG. 3(*a*), which shows the relationship between the parameter D1 and the return loss. D1 is the length of the first extending portion 231. The vertical axis of FIG. 3(*a*) is the return loss, and the horizontal axis thereof is the frequency. As shown in FIG. 3(*a*), when the return loss is −10 dB, with gradual shortening of the length D1, the central operating frequency moves to the right (high frequency). FIG. 3(*a*) shows that the length D1 of the first extending portion 231 determines the central operating frequency of the antenna structure 20.

Please refer to FIG. 3(*b*), which shows the relationship between the parameter D2 and the return loss. D2 is the length of the second extending portion 232. The vertical axis of FIG. 3(*b*) is the return loss, and the horizontal axis thereof is the frequency. As shown in FIG. 3(*b*), when the return loss is −10 dB, the central operating frequency does not change with D2; however, when D2 is shortened, the operating bandwidth is increased. FIG. 3(*b*) shows that the length D2 of the second extending portion 232 determines the operating bandwidth of the antenna structure 20.

Please refer to FIG. 3(*c*), which shows the relationship between the parameter D3 and the return loss, wherein the width D4 of the ground extending region 221 is fixed, and the length D3 thereof is varied. The vertical axis of FIG. 3(*c*) is the return loss, and the horizontal axis thereof is the frequency. As shown in FIG. 3(*c*), when the return loss is −10 dB, the central operating frequency does not significantly change with D3; however, the shorter the length D3 is, the smaller the area formed by the point a, the point b and the line A is. That is, the curve tends toward the line A, which represents that the impedance matching of the antenna structure 20 is worse.

Please refer to FIG. 3(*d*), which shows the relationship between the parameter D4 and the return loss, wherein the length D3 of the ground extending region 221 is fixed, and the width D4 thereof is varied. The vertical axis of FIG. 3(*d*) is the return loss, and the horizontal axis thereof is the frequency. As shown in FIG. 3(*d*), when the return loss is −10 dB, the central operating frequency does not significantly change with D4; however, the shorter the width D4 is, the smaller the area formed by the point a, the point b and the line A is. That is, the curve tends toward the line A, which represents that the impedance matching of the antenna structure 20 is worse. It is known from FIGS. 3(*c*) and 3(*d*) that the best length D3 of the ground extending region 221 is 4 mm, and the best width D4 thereof is 2 mm.

Figure 4:
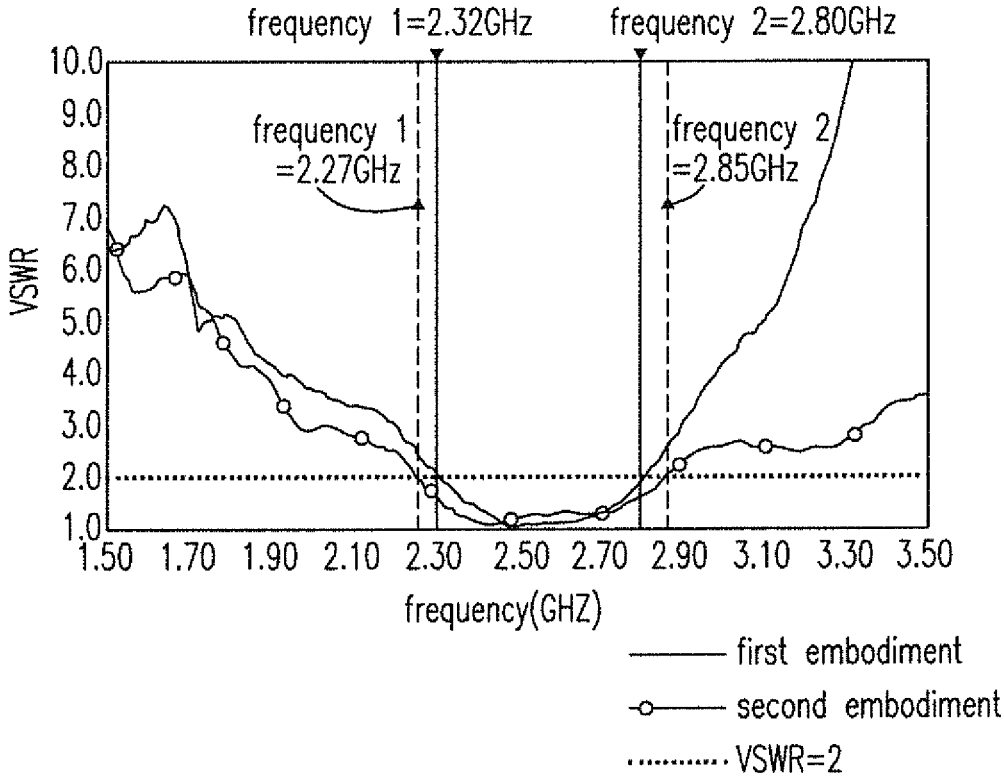
FIG. 4 shows the test result of the voltage standing wave ratio (VSWR) of the antenna structure according to different embodiments of the present invention.

Please refer to FIG. 4, which shows the test result of the voltage standing wave ratio (VSWR) of the antenna structure according to different embodiments of the present invention. The vertical axis of FIG. 4 is the VSWR, and the horizontal axis thereof is the frequency. As shown in FIG. 4, when the VSWR is below 2, the bandwidth of the first embodiment is 2.32~2.8 GHz, and the bandwidth of the second embodiment is 2.27~2.85 GHz. It is known from FIG. 4 that the first embodiment with the band of 480 MHz can fully cover the bandwidth of the wireless communication under the IEEE 802.11bg, and the second embodiment with the band of 580 MHz can fully cover the bandwidth of the wireless communication under the LTE (2300~2700 MHz). The reflection loss test is also performed for the first and the second embodiments, and the same result is obtained. Therefore, the present invention can achieve the purpose of changing the operating bandwidth.

According to an embodiment of the present invention, the body 233, the first extending portion 231 and the second extending portion 232 are coplanar. The first extending portion 231 and the second extending portion 232 are disposed at the same side of the fourth side S4, and the extending direction of the first extending portion 231 is parallel with that of the second extending portion 232. There is a second space 28 between the first extending portion 231 and the second extending portion 232.

According to an embodiment of the present invention, there is the first space 26 between the first extending portion 231 and the body 233. The second space 28 is smaller than the first space 26.

According to an embodiment of the present invention, the lower edge of the second extending portion 232 is aligned with the first side S1.

According to an embodiment of the present invention, the antenna structure 20 is disposed on the substrate 21. The substrate 21 is a printed circuit board including a first side and a second side. The antenna structure 20 is disposed in a particular region of the first side. The second side includes a ground metal surface (not shown) or a nonmetallic surface (not shown). The projective area of the antenna structure 20 from a top view does not overlap the ground metal surface or the nonmetallic surface.

According to an embodiment of the present invention, the ground portion 23 surrounds the entire length of the first side S1, the entire length of the fourth side S4 and at most a half of the length L2 of the second side S2. Besides, the ground portion 22 is not electrically connected to the radiating portion 23.

According to the embodiments of the present invention, the present invention can achieve a printed monopole antenna with a single central operating frequency, wherein the band of the printed monopole antenna is easy to be adjusted. The present invention can adjust the bandwidth via a particular supplying block (e.g. the second extending portion 232 in the embodiments of the present invention). For example, when the bandwidth of the system is insufficient, the particular supplying block can be used to increase the bandwidth. The band to be used can also be adjusted via the particular supplying block so that the present invention can be applied to the operating band of WiFi 802.11b/g/n (2.40~2.50 GHz), or to the operating band of the LTE. For example, the operating band of the LTE can be the LTE-Band 7 (2500~2690 MHz), the LTE-Band 40 (2300~2400 MHz) or the LTE-Band 38 (2570~2620 MHz). The general monopole antenna does not have an additional ground terminal like the planar inverted F antenna (PIFA). Therefore, the size of the general monopole antenna is smaller than that of the PIFA. The ground portion 22 of the present invention is not electrically connected to the radiating portion 23 so that the radiation generated by the radiating portion 23 is not directly affected by elements related to the ground portion 22. Moreover, the method for feeding the antenna signal in the present invention is to directly feed the antenna signal on the printed circuit board (PCB) in the way of 50Ω. This not only saves the cost of using the cable for feeding, but also saves the costs of the mold and assembly for the three-dimensional antenna.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna structure comprising:

a radiating portion having a quadrangular body, wherein the quadrangular body has a first side, a second side opposite to the first side, a third side, and a fourth side opposite to the third side;

a feeding terminal adjacent to the first side;

a first extending portion determining a central operating frequency of the antenna structure, and extending from the second side to form a first space between the first extending portion and the second side, wherein the first extending portion includes a connecting end and an open end, wherein the connecting end is connected to the second side, extends toward a first direction from the second side, forms a first bend, and then extends toward a second direction; and a second extending portion determining an operating bandwidth of the antenna structure, wherein the second extending portion extends from the third side, wherein a length of the first extending portion along the second direction is larger than a length of the second extending portion, the first extending portion has a width smaller than that of the second extending portion, the width of the first extending portion is smaller than a length of the second side, and the width of the second extending portion is smaller than a length of the third side.

2. An antenna structure as claimed in claim 1, wherein the first extending portion extends toward the open end along the second direction, and forms a second bend near the open end, wherein the second bend has an interior angle larger than 90 degrees.

3. An antenna structure as claimed in claim 2, wherein the second extending portion extends toward the second direction from the third side, and is parallel with the first extending portion.

4. An antenna structure as claimed in claim 3, wherein the quadrangular body, the first extending portion, and the second extending portion are coplanar.

5. An antenna structure as claimed in claim 2, wherein:

the third side, the first extending portion, and the second extending portion have a second space therebetween; and the second space is larger than the first space.

6. An antenna structure as claimed in claim 1, wherein the second extending portion has a lower edge aligned with the first side.

7. An antenna structure as claimed in claim 6, wherein the antenna structure is a monopole structure.

8. An antenna structure as claimed in claim 7, wherein the length of the second extending portion determines the operating bandwidth of the antenna structure so that the antenna structure has a characteristic of a single operating bandwidth.

* * * * *